US007147543B2

(12) United States Patent
Chandrasekaran

(10) Patent No.: US 7,147,543 B2
(45) Date of Patent: Dec. 12, 2006

(54) CARRIER ASSEMBLIES, PLANARIZING APPARATUSES INCLUDING CARRIER ASSEMBLIES, AND METHODS FOR PLANARIZING MICRO-DEVICE WORKPIECES

(75) Inventor: Nagasubramaniyan Chandrasekaran, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/192,297

(22) Filed: Jul. 28, 2005

(65) Prior Publication Data

US 2005/0260927 A1 Nov. 24, 2005

Related U.S. Application Data

(60) Continuation of application No. 11/010,537, filed on Dec. 13, 2004, now Pat. No. 6,958,001, which is a division of application No. 10/226,571, filed on Aug. 23, 2002, now Pat. No. 7,004,817.

(51) Int. Cl.
*B24B 7/22* (2006.01)

(52) U.S. Cl. ..... 451/11; 451/41; 451/287; 451/494; 451/905

(58) Field of Classification Search ..... 451/9, 451/11, 36, 41, 285–290, 494, 550, 905
See application file for complete search history.

(56) References Cited

U.S. PATENT DOCUMENTS 5,036,015 A 7/1991 Sandhu et al.
5,069,002 A 12/1991 Sandhu et al.
5,081,796 A 1/1992 Schultz
5,222,329 A 6/1993 Yu
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,413,941 A 5/1995 Koos et al.
5,421,769 A 6/1995 Schultz et al.
5,433,651 A 7/1995 Lustig et al.
5,439,551 A 8/1995 Meikle et al.
5,449,314 A 9/1995 Meikle et al.
5,486,129 A 1/1996 Sandhu et al.
5,514,245 A 5/1996 Doan et al.
5,533,924 A 7/1996 Stroupe et al.

(Continued)

OTHER PUBLICATIONS

U.S. Appl. No. 11/187,280, filed Jul. 22, 2005, Elledge.

(Continued)

*Primary Examiner*—Lee D. Wilson
*Assistant Examiner*—Anthony Ojini
(74) *Attorney, Agent, or Firm*—Perkins Coie LLP

(57) ABSTRACT

Carrier assemblies, planarizing machines with carrier assemblies, and methods for mechanical and/or chemical-mechanical planarization of micro-device workpieces are disclosed herein. In one embodiment, the carrier assembly includes a head having a chamber, a magnetic field source carried by the head, and a fluid with magnetic elements in the chamber. The magnetic field source has a first member that induces a magnetic field in the head. The fluid and/or the magnetic elements move within the chamber under the influence of the magnetic field source to exert a force against a portion of the micro-device workpiece. In a further aspect of this embodiment, the carrier assembly includes a flexible member in the chamber. The magnetic field source can be any device that induces a magnetic field, such as a permanent magnet, an electromagnet, or an electrically conductive coil.

20 Claims, 6 Drawing Sheets

U.S. PATENT DOCUMENTS

| | | | | |
|---|---|---|---|---|
| 5,540,810 | A | 7/1996 | Sandhu et al. | |
| 5,609,718 | A | 3/1997 | Meikle | |
| 5,618,381 | A | 4/1997 | Doan et al. | |
| 5,618,447 | A | 4/1997 | Sandhu | |
| 5,643,048 | A | 7/1997 | Iyer | |
| 5,643,053 | A * | 7/1997 | Shendon | 451/28 |
| 5,643,060 | A | 7/1997 | Sandhu et al. | |
| 5,658,183 | A | 8/1997 | Sandhu et al. | |
| 5,658,190 | A | 8/1997 | Wright et al. | |
| 5,663,797 | A | 9/1997 | Sandhu | |
| 5,664,988 | A | 9/1997 | Stroupe et al. | |
| 5,679,065 | A | 10/1997 | Henderson | |
| 5,681,215 | A * | 10/1997 | Sherwood et al. | 451/388 |
| 5,700,180 | A | 12/1997 | Sandhu et al. | |
| 5,702,292 | A | 12/1997 | Brunelli et al. | |
| 5,730,642 | A | 3/1998 | Sandhu et al. | |
| 5,738,562 | A | 4/1998 | Doan et al. | |
| 5,747,386 | A | 5/1998 | Moore | |
| 5,777,739 | A | 7/1998 | Sandhu et al. | |
| 5,792,709 | A | 8/1998 | Robinson et al. | |
| 5,795,495 | A | 8/1998 | Meikle | |
| 5,798,302 | A | 8/1998 | Hudson et al. | |
| 5,807,165 | A | 9/1998 | Uzoh et al. | |
| 5,830,806 | A | 11/1998 | Hudson et al. | |
| 5,836,807 | A * | 11/1998 | Leach | 451/41 |
| 5,842,909 | A | 12/1998 | Sandhu et al. | |
| 5,851,135 | A | 12/1998 | Sandhu et al. | |
| 5,855,804 | A | 1/1999 | Walker | |
| 5,868,896 | A | 2/1999 | Robinson et al. | |
| 5,882,248 | A | 3/1999 | Wright et al. | |
| 5,893,754 | A | 4/1999 | Robinson et al. | |
| 5,895,550 | A | 4/1999 | Andreas | |
| 5,910,846 | A | 6/1999 | Sandhu | |
| 5,916,012 | A | 6/1999 | Pant et al. | |
| 5,930,699 | A | 7/1999 | Bhatia | |
| 5,931,718 | A | 8/1999 | Komanduri et al. | |
| 5,931,719 | A | 8/1999 | Nagahara et al. | |
| 5,934,980 | A | 8/1999 | Koos et al. | |
| 5,936,733 | A | 8/1999 | Sandhu et al. | |
| 5,945,347 | A | 8/1999 | Wright | |
| 5,954,912 | A | 9/1999 | Moore | |
| 5,967,030 | A | 10/1999 | Blalock | |
| 5,972,792 | A | 10/1999 | Hudson | |
| 5,980,363 | A | 11/1999 | Meikle et al. | |
| 5,981,396 | A | 11/1999 | Robinson et al. | |
| 5,994,224 | A | 11/1999 | Sandhu et al. | |
| 5,997,384 | A | 12/1999 | Blalock | |
| 6,007,408 | A | 12/1999 | Sandhu | |
| 6,039,633 | A | 3/2000 | Chopra | |
| 6,040,245 | A | 3/2000 | Sandhu et al. | |
| 6,046,111 | A | 4/2000 | Robinson | |
| 6,054,015 | A | 4/2000 | Brunelli et al. | |
| 6,057,602 | A | 5/2000 | Hudson et al. | |
| 6,059,638 | A * | 5/2000 | Crevasse et al. | 451/41 |
| 6,066,030 | A | 5/2000 | Uzoh | |
| 6,074,286 | A | 6/2000 | Ball | |
| 6,083,085 | A | 7/2000 | Lankford | |
| 6,108,092 | A | 8/2000 | Sandhu | |
| 6,110,820 | A | 8/2000 | Sandhu et al. | |
| 6,113,467 | A * | 9/2000 | Koike | 451/41 |
| 6,116,988 | A | 9/2000 | Ball | |
| 6,120,354 | A | 9/2000 | Koos et al. | |
| 6,135,856 | A | 10/2000 | Tjaden et al. | |
| 6,139,402 | A | 10/2000 | Moore | |
| 6,143,123 | A | 11/2000 | Robinson et al. | |
| 6,143,155 | A | 11/2000 | Adams et al. | |
| 6,152,808 | A | 11/2000 | Moore | |
| 6,176,992 | B1 | 1/2001 | Talieh | |
| 6,180,525 | B1 | 1/2001 | Morgan | |
| 6,184,571 | B1 | 2/2001 | Moore | |
| 6,187,681 | B1 | 2/2001 | Moore | |
| 6,190,494 | B1 | 2/2001 | Dow | |
| 6,191,037 | B1 | 2/2001 | Robinson et al. | |
| 6,191,864 | B1 | 2/2001 | Sandhu | |
| 6,193,588 | B1 | 2/2001 | Carlson et al. | |
| 6,200,901 | B1 | 3/2001 | Hudson et al. | |
| 6,203,404 | B1 | 3/2001 | Joslyn et al. | |
| 6,203,407 | B1 | 3/2001 | Robinson | |
| 6,203,413 | B1 | 3/2001 | Skrovan | |
| 6,206,754 | B1 | 3/2001 | Moore | |
| 6,206,756 | B1 | 3/2001 | Chopra et al. | |
| 6,206,769 | B1 | 3/2001 | Walker | |
| 6,208,425 | B1 | 3/2001 | Sandhu et al. | |
| 6,210,257 | B1 | 4/2001 | Carlson | |
| 6,213,845 | B1 | 4/2001 | Elledge | |
| 6,218,316 | B1 | 4/2001 | Marsh | |
| 6,224,466 | B1 | 5/2001 | Walker et al. | |
| 6,227,955 | B1 | 5/2001 | Custer et al. | |
| 6,234,868 | B1 * | 5/2001 | Easter et al. | 451/5 |
| 6,234,874 | B1 | 5/2001 | Ball | |
| 6,234,877 | B1 | 5/2001 | Koos et al. | |
| 6,234,878 | B1 | 5/2001 | Moore | |
| 6,237,483 | B1 | 5/2001 | Blalock | |
| 6,250,994 | B1 | 6/2001 | Chopra et al. | |
| 6,251,785 | B1 | 6/2001 | Wright | |
| 6,261,151 | B1 | 7/2001 | Sandhu et al. | |
| 6,261,163 | B1 | 7/2001 | Walker et al. | |
| 6,267,650 | B1 | 7/2001 | Hembree | |
| 6,273,786 | B1 | 8/2001 | Chopra et al. | |
| 6,273,796 | B1 | 8/2001 | Moore | |
| 6,276,996 | B1 | 8/2001 | Chopra | |
| 6,284,660 | B1 | 9/2001 | Doan | |
| 6,287,879 | B1 | 9/2001 | Gonzales et al. | |
| 6,290,572 | B1 | 9/2001 | Hofmann | |
| 6,297,159 | B1 | 10/2001 | Paton | |
| 6,301,006 | B1 | 10/2001 | Doan | |
| 6,306,012 | B1 | 10/2001 | Sabde | |
| 6,306,014 | B1 | 10/2001 | Walker et al. | |
| 6,306,768 | B1 | 10/2001 | Klein | |
| 6,312,558 | B1 | 11/2001 | Moore | |
| 6,313,038 | B1 | 11/2001 | Chopra et al. | |
| 6,319,420 | B1 | 11/2001 | Dow | |
| 6,323,046 | B1 | 11/2001 | Agarwal | |
| 6,328,632 | B1 | 12/2001 | Chopra | |
| 6,331,488 | B1 | 12/2001 | Doan et al. | |
| 6,338,667 | B1 | 1/2002 | Sandhu et al. | |
| 6,350,180 | B1 | 2/2002 | Southwick | |
| 6,350,691 | B1 | 2/2002 | Lankford | |
| 6,352,466 | B1 | 3/2002 | Moore | |
| 6,354,923 | B1 | 3/2002 | Lankford | |
| 6,354,928 | B1 * | 3/2002 | Crevasse et al. | 451/397 |
| 6,354,930 | B1 | 3/2002 | Moore | |
| 6,358,122 | B1 | 3/2002 | Sabde et al. | |
| 6,358,127 | B1 | 3/2002 | Carlson et al. | |
| 6,358,129 | B1 | 3/2002 | Dow | |
| 6,361,417 | B1 | 3/2002 | Walker et al. | |
| 6,362,105 | B1 | 3/2002 | Moore | |
| 6,364,746 | B1 | 4/2002 | Moore | |
| 6,364,757 | B1 | 4/2002 | Moore | |
| 6,368,190 | B1 | 4/2002 | Easter et al. | |
| 6,368,193 | B1 | 4/2002 | Carlson et al. | |
| 6,368,194 | B1 | 4/2002 | Sharples et al. | |
| 6,368,197 | B1 | 4/2002 | Elledge | |
| 6,376,381 | B1 | 4/2002 | Sabde | |
| 6,387,289 | B1 | 5/2002 | Wright | |
| 6,402,884 | B1 | 6/2002 | Robinson et al. | |
| 6,402,978 | B1 * | 6/2002 | Levin | 252/62.52 |
| 6,436,826 | B1 * | 8/2002 | Pyo | 438/687 |
| 6,436,828 | B1 | 8/2002 | Chen et al. | |
| 6,447,369 | B1 | 9/2002 | Moore | |
| 6,482,077 | B1 | 11/2002 | Doan et al. | |
| 6,579,799 | B1 | 6/2003 | Chopra et al. | |
| 6,609,947 | B1 | 8/2003 | Moore | |
| 6,776,688 | B1 | 8/2004 | Kim et al. | |

| | | | |
|---|---|---|---|
| 2004/0038625 | A1 | 2/2004 | Chandrasekaran |
| 2004/0142635 | A1 | 7/2004 | Elledge |
| 2004/0214514 | A1 | 10/2004 | Elledge |
| 2005/0026544 | A1 | 2/2005 | Elledge |
| 2005/0118930 | A1 | 6/2005 | Chandrasekaran |

OTHER PUBLICATIONS

Carlson, J. David, "What Makes a Good MR Fluid?" pp. 1-7, 8th Annual International Conference on Electrorheological (ER) Fluids and Magneto-rheological (MR) Suspensions, Nice, France, Jul. 9-13, 2001.

Jolly, Mark R. et al., "Properties and Applications of Commercial Magnetorheological Fluids," 18 pages, SPIE 5th Annual International Symposium on Smart Structures and Materials, San Diego, California, Mar. 15, 1998.

Kondo, S. et al., "Abrasive-Free Polishing for Copper Damascene Interconnection," Journal of The Electrochemical Society, vol. 147, No. 10, pp. 3907-3913, 2000, The Electrochemical Society, Inc.

Lord Corporation, "Commercial Leader in MR Technology," 1 page, retrieved from the Internet on Jun. 14, 2002, <http://www.rheonetic.com>.

Lord Corporation, "Designing with MR Fluids," 5 pages, Engineering Note, Dec. 1999, Cary, North Carolina.

Lord Corporation, "Magnetic Circuit Design," 4 pages, Engineering Note, Nov. 1999, Cary, North Carolina.

Lord Corporation, "Magneto-Rheological Fluids References," 3 pages, retrieved from the Internet on Jun. 14, 2002, <http://www.rheonetic.com/tech_library/mr_fluid.htm>.

Lord Materials Division, "What is the Difference Between MR and ER Fluid?" 6 pages, Cary, North Carolina, presented May 2002.

* cited by examiner

CARRIER ASSEMBLIES, PLANARIZING APPARATUSES INCLUDING CARRIER ASSEMBLIES, AND METHODS FOR PLANARIZING MICRO-DEVICE WORKPIECES

CROSS-REFERENCE TO RELATED APPLICATIONS

This application is a continuation of U.S. patent application Ser. No. 11/010,537, filed Dec. 13, 2004, now U.S. Pat. No. 6,958,001 which is a divisional of U.S. patent application Ser. No. 10/226,571, filed Aug. 23, 2002, now U.S. Pat. No. 7,004,817 both of which are incorporated herein by reference in their entireties.

TECHNICAL FIELD

The present invention relates to carrier assemblies, planarizing machines including carrier assemblies, and methods for mechanical and/or chemical-mechanical planarization of micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier head 30 presses the workpiece 12 face-down against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the workpiece 12 to enable precise fabrication of circuits and photo-patterns. A nonuniform surface can result, for example, when material from certain areas of the workpiece 12 is removed more quickly than material from other areas during CMP processing. To compensate for the nonuniform removal of material, carrier heads have been developed with expandable interior and exterior bladders that exert downward forces on selected areas of the workpiece 12. These carrier heads, however, have several drawbacks. For example, the bladders typically have curved edges that make it difficult to exert a uniform downward force at the perimeter of the bladder. Additionally, the bladders cover a fairly broad area of the workpiece 12, which limits the ability to localize the downforce. Conventional bladders accordingly may not provide precise control of the localized force. For example, in some embodiments, the exterior bladders are coupled to a moveable retaining ring that slides vertically during the planarizing process. The vertical movement of the retaining ring displaces such attached bladders, which inhibits the ability of the attached bladders to provide a controlled force near the edge of the workpiece 12. Furthermore, carrier heads with multiple bladders frequently fail resulting in significant downtime for repair and/or maintenance, causing a concomitant reduction in throughput.

SUMMARY

The present invention is directed toward carrier assemblies, planarizing machines with carrier assemblies, and methods for mechanical and/or chemical-mechanical planarization of micro-device workpieces. In one embodiment, the carrier assembly includes a head having a chamber, a magnetic field source carried by the head, and a fluid with magnetic elements in the chamber. The magnetic field source has a first member that induces a magnetic field in the head. The fluid and/or the magnetic elements move within the chamber under the influence of the magnetic field source to exert a force against a discrete portion of the micro-device workpiece. In a further aspect of this embodiment, the carrier assembly includes a flexible member in the chamber. The flexible member partially defines an enclosed cavity. The magnetic field source can be any device that induces a magnetic field, such as a permanent magnet, an electromagnet, or an electrically conductive coil. Furthermore, the magnetic field source can have various magnetic members that each individually induce magnetic fields to apply different downforces to discrete regions of the workpiece. For example, these magnetic members can be configured in various shapes, such as quadrants, annular sections, and/or sectors of a grid.

In a further aspect of the invention, the carrier assembly includes a plurality of magnets, a head carrying the plurality of magnets, and a magnetic fluid including magnetic elements within the head. Each of the magnets can selectively induce a magnetic field in the magnetic fluid. The head includes a cavity having sections proximate to each magnet. When a magnet induces a magnetic field in one of the sections, the magnetic fluid and/or the magnetic elements move toward the corresponding section of the cavity and cause a force against the micro-device workpiece. In another aspect of the invention, the carrier assembly includes a head having a cavity with a first section, a means for selectively inducing a magnetic field carried by the head, a flexible member carried by the head, and a magnetic means for exerting pressure against the flexible member in the cavity. The magnetic means moves in the cavity under the influence of the means for selectively inducing the magnetic field to exert pressure against a portion of the flexible member. The flexible member is positionable proximate to the micro-device workpiece so that the pressure against the flexible member can be applied to the workpiece.

A method for polishing a micro-device workpiece with a polishing machine having a carrier head and a polishing pad includes moving at least one of the carrier head and the polishing pad relative to the other to rub the workpiece against the polishing pad. The carrier head includes a cavity and a magnetic fluid within the cavity. The method further includes exerting a force against a backside of the workpiece by inducing a magnetic field in the carrier head that displaces a portion of the magnetic fluid within the cavity of the carrier head. In another embodiment, a method for manufacturing a carrier head for use on a planarizing machine includes coupling a magnet configured to induce magnetic fields to the carrier head and disposing a fluid with magnetic elements within a cavity in the carrier head.

DETAILED DESCRIPTION

The present invention is directed to carrier assemblies, planarizing apparatuses including carrier assemblies, and methods for mechanical and/or chemical-mechanical planarization of micro-device workpieces. The term "micro-device workpiece" is used throughout to include substrates in or on which micro-electronic devices, micro-mechanical devices, data storage elements, and other features are fabricated. For example, micro-device workpieces can be semiconductor wafers, glass substrates, insulated substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–4B to provide a thorough understanding of certain embodiments of the invention. One skilled in the art, however, will understand that the present invention may have additional embodiments, or that other embodiments of the invention may be practiced without several of the specific features explained in the following description.

Figure 1:
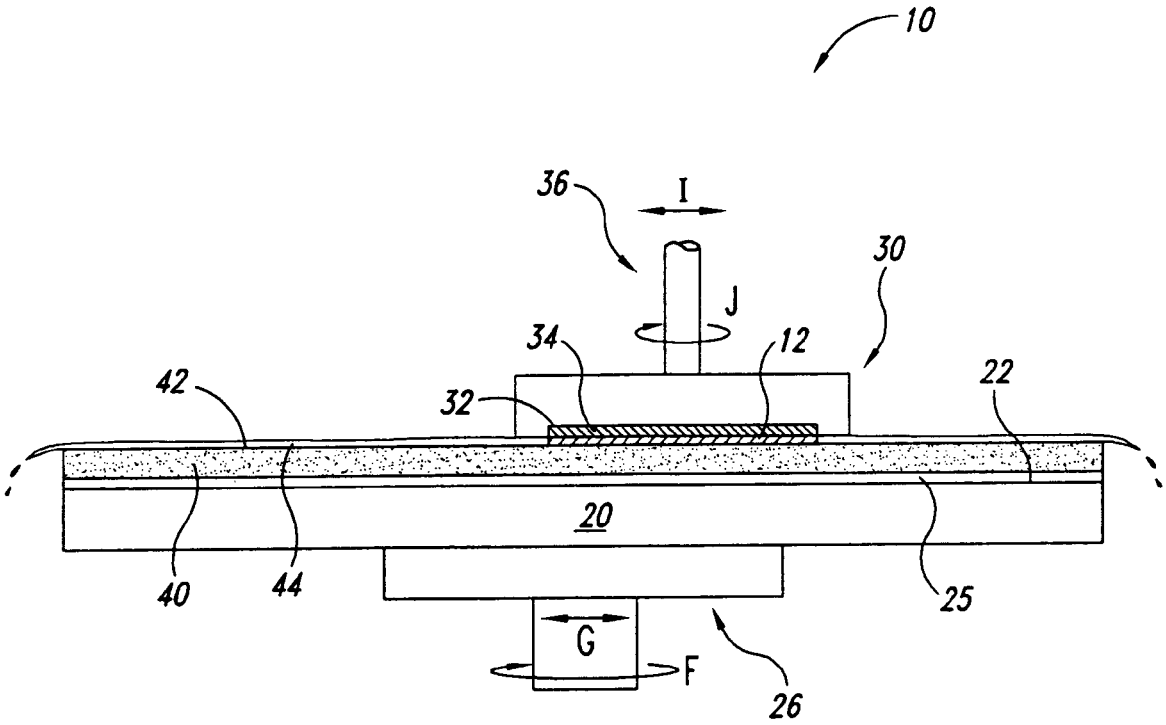
Fig. 1 (Prior Art)
FIG. 1 is a side schematic cross-sectional view of a portion of a rotary planarizing machine in accordance with the prior art.
Figure 2A:
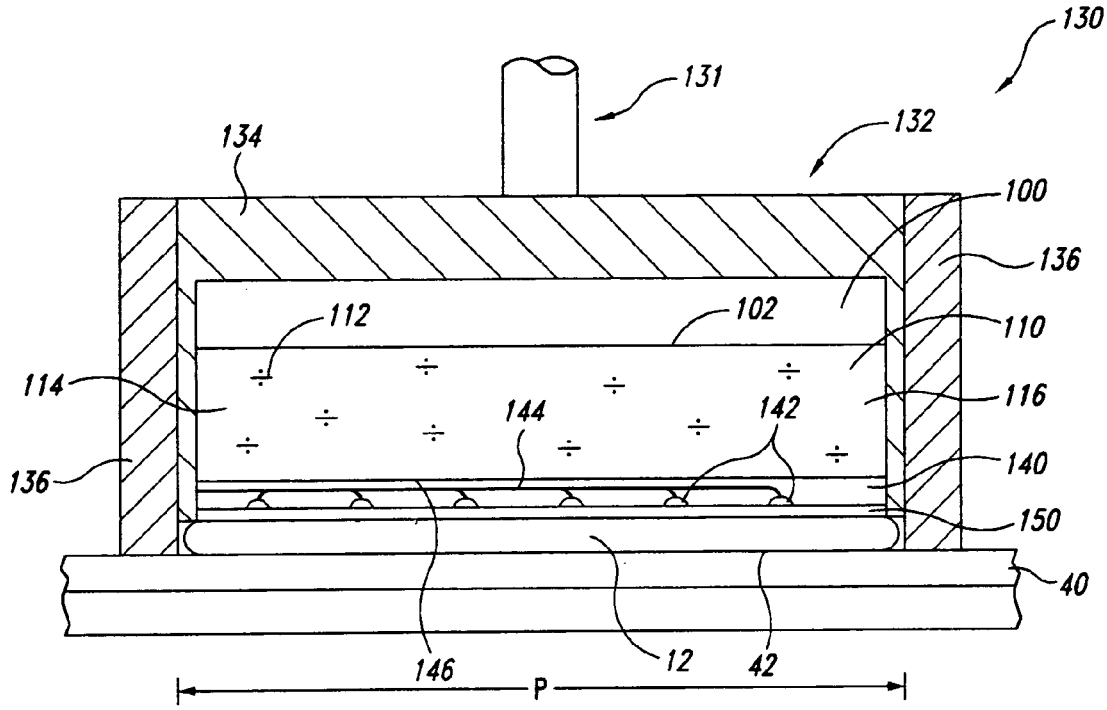
FIG. 2A is a side schematic cross-sectional view of a carrier assembly in accordance with one embodiment of the invention.

FIG. 2A is a side schematic cross-sectional view of a carrier assembly 130 in accordance with one embodiment of the invention. The carrier assembly 130 can be coupled to an actuator assembly 131 to move the workpiece 12 across the planarizing surface 42 of the planarizing pad 40. In the illustrated embodiment, the carrier assembly 130 includes a head 132 having a support member 134 and a retaining ring 136 coupled to the support member 134. The support member 134 can be an annular housing having an upper plate coupled to the actuator assembly 131. The retaining ring 136 extends around the support member 134, and the retaining ring 136 can project toward the workpiece 12 below a bottom rim of the support member 134.

In the illustrated embodiment, the carrier assembly 130 also includes a chamber 114 in the support member 134, a magnetic field source 100 in the chamber 114, and a magnetic fluid 110 in the chamber 114. The magnetic field source 100 can be a permanent magnet, an electromagnet, an electrical coil, or any other device that creates magnetic fields in the chamber 114. The magnetic field source 100 can have a single magnetic source or a plurality of magnetic sources with various configurations, such as those described below with reference to FIGS. 3A–3E. In other embodiments, the magnetic field source 100 can be external to the chamber 114, such as being positioned in or above the support member 134.

The magnetic fluid 110 contains magnetic elements 112 disposed within the chamber 114 that can be influenced by the magnetic field(s). For example, a magnetic field can attract the magnetic elements 112 to a specific area of the chamber 114, or a magnetic field can repel the magnetic elements 112 from a specific area of the chamber 114. The concentration, properties and size of magnetic elements 112 control the magnetic properties of the magnetic fluid 110 in a manner that exerts a controlled driving force within the fluid 110. For example, if the magnetic fluid 110 has a large concentration of relatively small magnetic elements 112, the fluid 110 as a whole assumes magnetic properties. If, however, the magnetic elements 112 are relatively large, the magnetic elements 112 tend to respond as individual elements. In one embodiment, the magnetic fluid 110 can have a fluid base, such as water or kerosene, with magnetic elements 112 in suspension, such as iron oxide particles. In a further aspect of this embodiment, the magnetic elements 112 can have a polarity to further increase the attraction and/or repulsion between the magnetic elements 112 and the magnetic field source 100.

The carrier assembly 130 further includes a flexible plate 140 and a flexible member 150 coupled to the flexible plate 140. The flexible plate 140 sealably encloses the magnetic fluid 110 in the chamber 114, and thereby defines a cavity 116. The cavity 116 can have a depth of approximately 2–5 mm as measured from a first surface 102 of the magnetic field source 100 to a first surface 146 of the flexible plate 140. In other embodiments, the cavity 116 can have a depth greater than 5 mm. In the illustrated embodiment, the flexible plate 140 has a vacuum line 144 with holes 142 coupled to a vacuum source (not shown). The vacuum draws portions of the flexible member 150 into the holes 142 which creates small suction cups across the backside of the workpiece 12 that hold the workpiece 12 to the flexible member 150. In other embodiments, the flexible plate 140 may not include the vacuum line 144 and the workpiece 12 can be secured to the flexible member 150 by another device. In the illustrated embodiment, the flexible member 150 is a flexible membrane. However, in other embodiments, the flexible member 150 can be a bladder or another device that prevents planarizing solution (not shown) from entering the cavity 116. In additional embodiments, the flexible member 150 can be a thin conductor that can also induce magnetic field(s). This thin conductor can be used individually or in coordination with the magnetic field source 100 to create magnetic field(s). The flexible member 150 defines a polishing zone P in which the workpiece 12 can be planarized by moving relative to the planarizing pad 40.

Figure 2B:
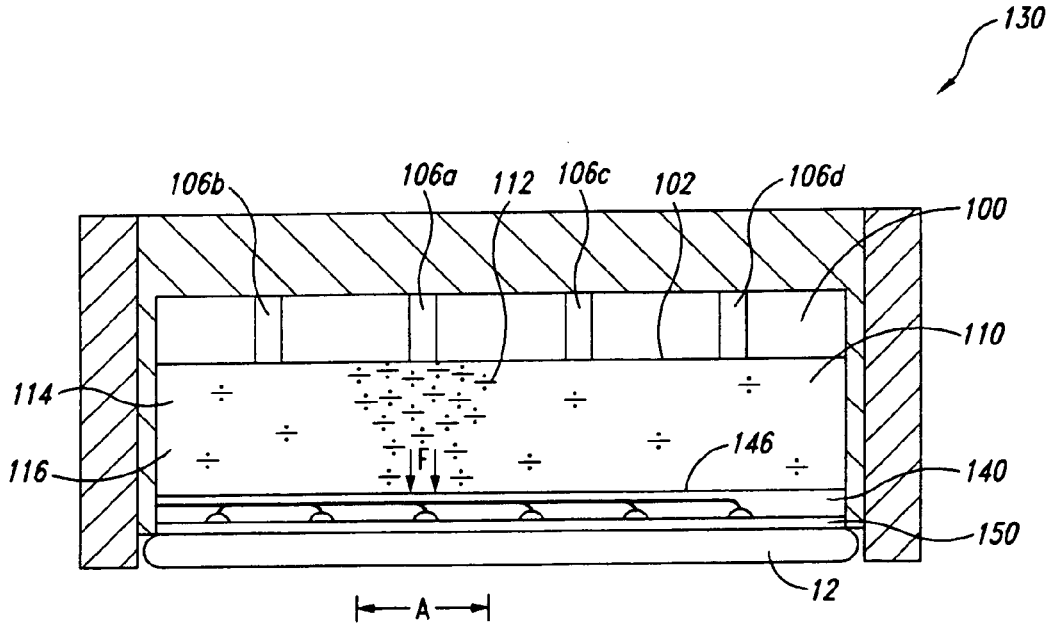
FIG. 2B is a side schematic cross-sectional view of the carrier assembly of FIG. 2A with a magnetic field induced.

FIG. 2B is a side schematic cross-sectional view of the carrier assembly 130 of FIG. 2A with a magnetic field induced. In operation, the magnetic field source 100 can selectively induce a magnetic field to exert a localized downward force F on the workpiece 12. In the illustrated embodiment, a magnetic member 106*a* of the magnetic field source 100 induces a magnetic field attracting the magnetic elements 112 in the magnetic fluid 110 toward a section A of the cavity 116 proximate to the magnetic member 106*a*. The magnetic elements 112 accumulate in the section A between the first surface 102 of the magnetic field source 100 and the first surface 146 of the flexible plate 140. As the magnetic field continues to attract the magnetic elements 112, they move laterally toward the magnetic field. Consequently, the magnetic elements 112 exert forces against each other in a manner that generates a downward force F on the flexible plate 140. The force F flexes the flexible plate 140 and the flexible member 150 downward. The force F is thus applied to the workpiece 12.

In a different embodiment, a similar force can be applied to the workpiece 12 when other magnetic members 106*b–d* around the magnetic member 106*a* induce magnetic fields repelling the magnetic elements 112. In this embodiment, the magnetic elements 112 would be driven toward the section A of the cavity 116. In any of the foregoing embodiments, the magnitude of the force F is determined by the strength of the magnetic field, the concentration of magnetic elements 112, the type of magnetic elements 112, the amount of magnetic fluid 110, the viscosity of the magnetic fluid 110, and other factors. The greater the magnetic field strength, the greater the magnitude of the force F. The location of the force F and the area over which the force F is applied to the workpiece 12 is determined by the location and size of the magnetic members 106 of the magnetic field source 100. In other embodiments, such as the embodiment illustrated in FIG. 4B, a plurality of discrete forces can be applied concurrently to the workpiece 12. In one embodiment, the magnetic members can induce magnetic fields and the associated forces based upon the profile of the workpiece. In additional embodiments, the entire magnetic field source 100 can induce a magnetic field to apply a downward force across the entire workpiece 12. Furthermore, the magnetic field source 100 can induce a magnetic field that attracts the magnetic elements 112 and thus reduces the force applied to the workpiece 12.

Figure 3A:
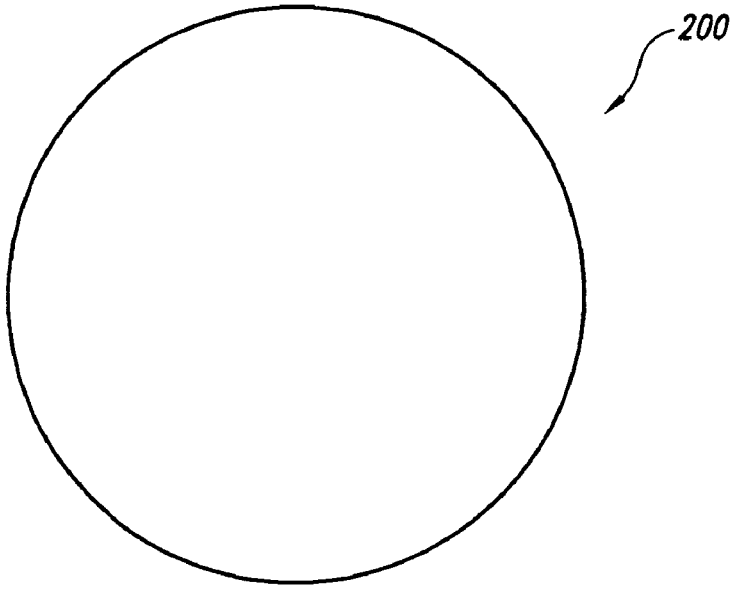
FIG. 3A is a top schematic view of a single circular magnetic field source in accordance with one embodiment of the invention.
Figure 3B:
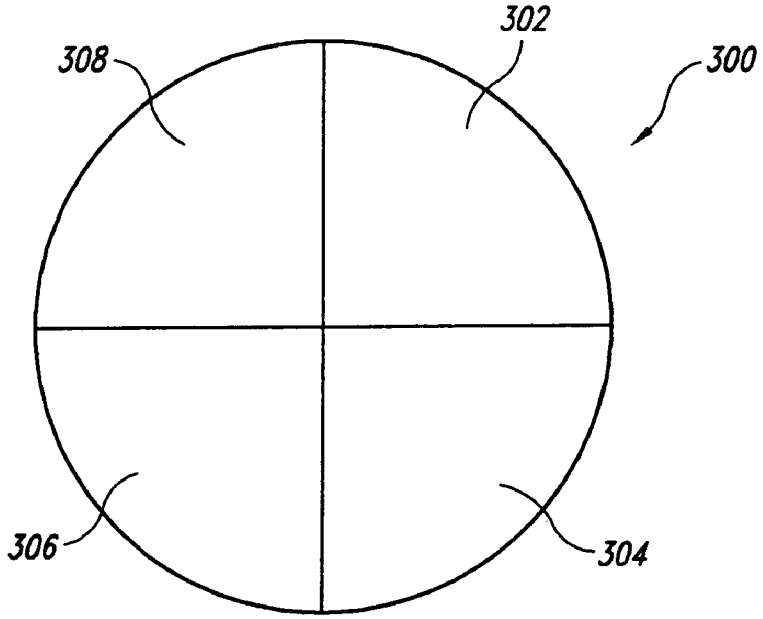
FIG. 3B is a top schematic view of a magnetic field source having quadrants in accordance with another embodiment of the invention.

FIGS. 3A–3E are schematic views of various magnetic field sources that selectively induce magnetic fields in accordance with additional embodiments of the invention. FIG. 3A illustrates a single circular magnetic field source 200, such as a permanent magnet or electromagnet. FIG. 3B is a top schematic view of a magnetic field source 300 with four magnetic members in accordance with another embodiment of the invention. The magnetic field source 300 includes a first magnetic member 302, a second magnetic member 304, a third magnetic member 306, and a fourth magnetic member 308 forming a circle. Each of the magnetic members 302, 304, 306 and 308 can be separate members that individually and selectively induces magnetic fields. For example, each magnetic member 302, 304, 306 and 308 can be an independent coil, a permanent magnet, or an electromagnet.

Figure 3C:
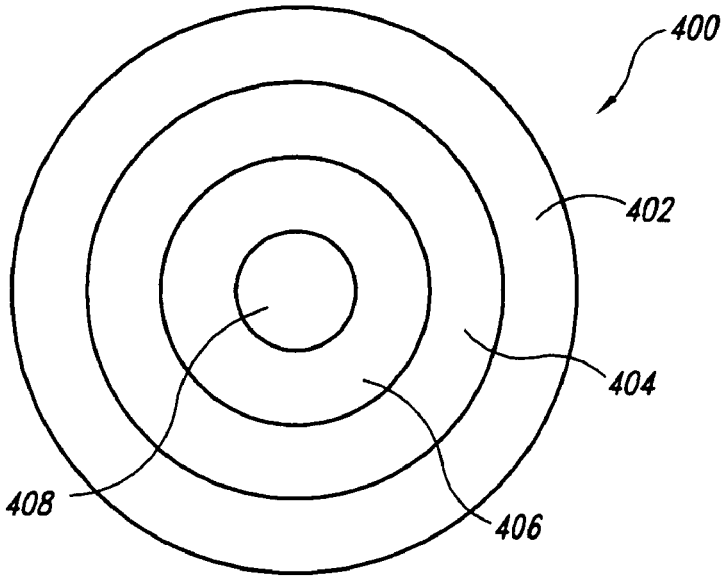
FIG. 3C is a top schematic view of a magnetic field source having annular magnetic members in accordance with yet another embodiment of the invention.

FIG. 3C is a top schematic view of a magnetic field source 400 with annular magnetic members in accordance with another embodiment of the invention. The magnetic field source 400 includes a first annular magnetic member 402, a second annular magnetic member 404, a third annular magnetic member 406, and a fourth magnetic member 408 that each selectively and independently induce a magnetic field. The first, second, and third annular magnetic members 402, 404 and 406 are arranged concentrically around the fourth magnetic member 408. For example, the first annular magnetic member 402 has an inner diameter that is equal to or greater than an outer diameter of the second annular magnetic member 404. In additional embodiments, the magnetic field source 400 can have additional annular magnetic members by decreasing the size of each member. In other embodiments, the magnetic members 402, 404, 406 and 408 can be spaced apart from each other by gaps. In still other embodiments, the annular magnetic members can be divided into segments to further increase the resolution with which magnetic fields can be induced in the chamber 114 (FIG. 2A).

Figure 3D:
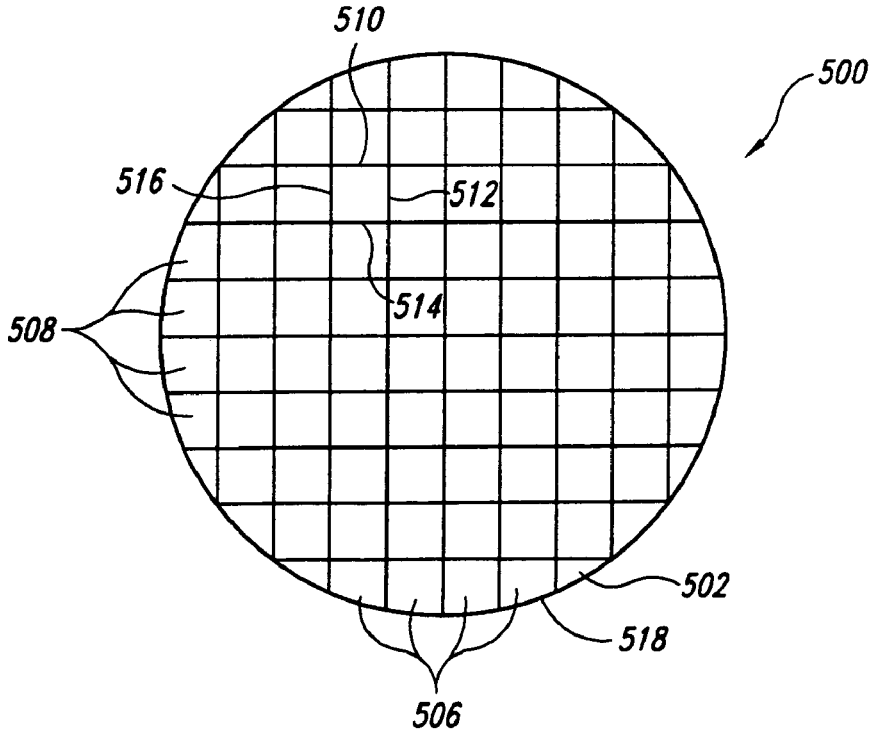
FIG. 3D is a top schematic view of a magnetic field source having a plurality of sectors arranged in a grid in accordance with still another embodiment of the invention.

FIG. 3D is a top schematic view of magnetic field source 500 in accordance with another embodiment of the invention. The magnetic field source 500 includes a plurality of sectors or members 502 arranged in a grid with columns 506 and rows 508. Each member 502 has a first side 510, a second side 512, a third side 514, and a fourth side 516, and each member 502 can individually and selectively induce a magnetic field. The first side 510 of one member 502 can contact or be spaced apart from the third side 514 of an adjacent member 502. In the illustrated embodiment, the members 502 proximate to the perimeter of the magnetic field source 500 have curved sides 518 corresponding to the curvature of the magnetic field source 500. In other embodiments, the magnetic field source can have members with other configurations, such as hexagonal or pentagonal shapes.

Figure 3E:
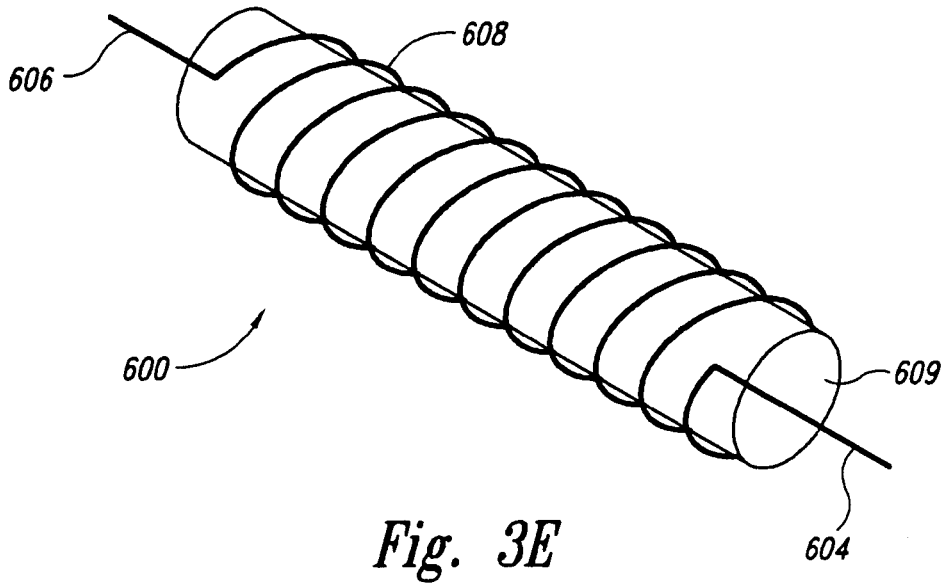
FIG. 3E is a side schematic view of a magnetic field source having coils in accordance with another embodiment of the invention.

FIG. 3E is a side schematic view of a magnetic field source 600 in accordance with another embodiment of the invention. The magnetic field source 600 includes an electrical coil 608 having a first end 604 and a second end 606 opposite the first end 604 configured to be coupled to a power source. The field source 600 can have an air core, or the coil 608 can be wound around an inductive core 609 to form a field having a higher flux density.

Figure 4A:
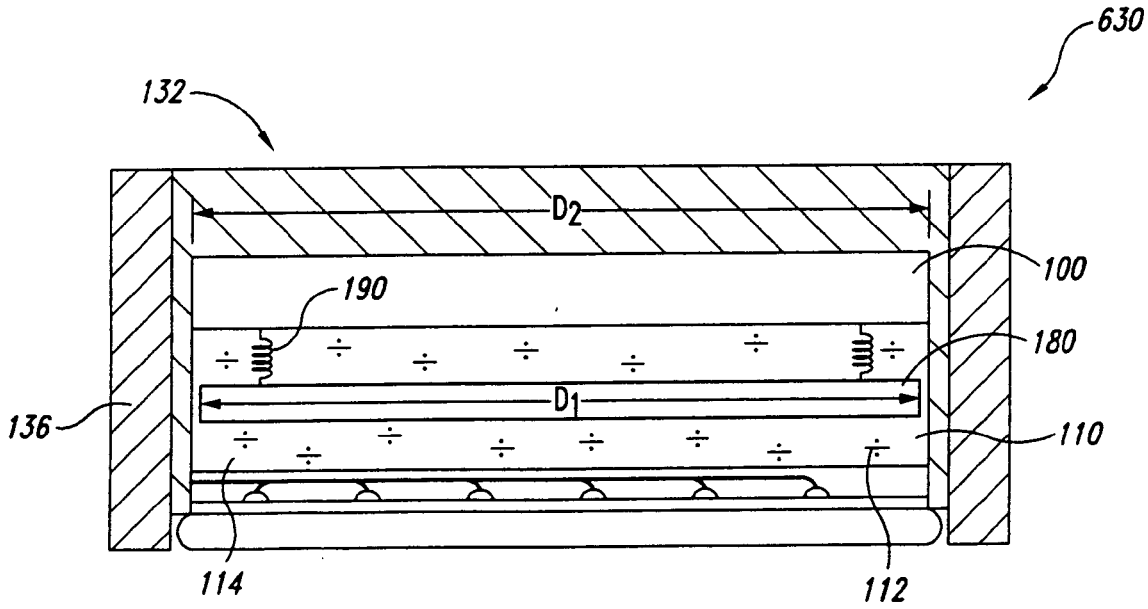
FIG. 4A is a side schematic cross-sectional view of a carrier assembly in accordance with another embodiment of the invention.

FIG. 4A is a side schematic cross-sectional view of a carrier assembly 630 in accordance with another embodiment of the invention. The carrier assembly 630 is similar to the carrier assembly 130 described above with reference to FIGS. 2A and 2B. For example, the carrier assembly 630 includes the head 132, the chamber 114, the magnetic field source 100, and the magnetic fluid 110. The carrier assembly 630 also includes a nonmagnetic float 180 disposed within the chamber 114. The nonmagnetic float 180 can be coupled to the magnetic field source 100 by a pair of biasing members 190, such as springs. In other embodiments, the nonmagnetic float 180 can be freely suspended in the magnetic fluid 110. In the illustrated embodiment, the nonmagnetic float 180 is positioned in the magnetic fluid 110 with magnetic elements 112 suspended above and below the nonmagnetic float 180. The diameter $D_1$ of the nonmagnetic float 180 is less than the inner diameter $D_2$ of the chamber 114 so that a gap exists between the nonmagnetic float 180 and the support member 134 (FIG. 2A) through which the magnetic fluid 110 can pass. In other embodiments, the nonmagnetic float 180 can have holes that allow the magnetic fluid 110 to pass through the float 180. In one embodiment, the nonmagnetic float 180 can be a lightweight, flexible material, such as acrylic. In other embodiments, other materials can be used, such as polymers and/or composites. In another embodiment, the nonmagnetic float 180 can have a thickness of about 0.020 to about 0.200 inches, and in a further aspect of this embodiment, the thickness can be about 0.050 inches.

Figure 4B:
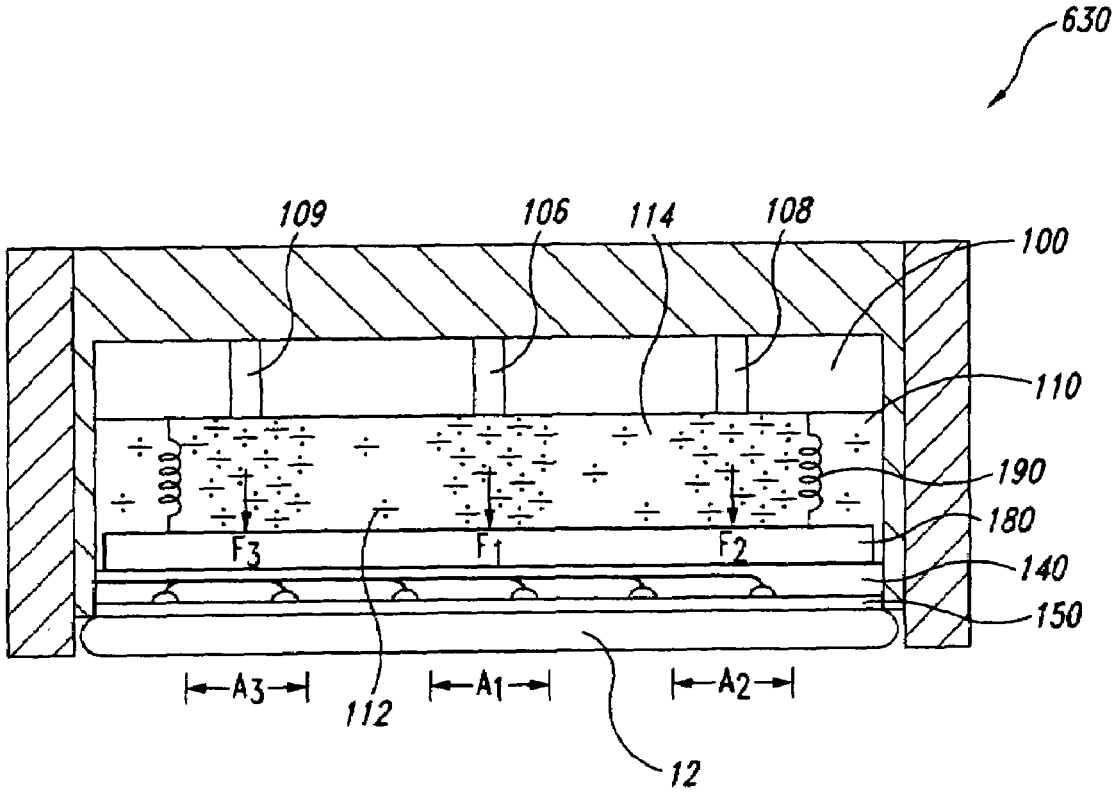
FIG. 4B is a side schematic cross-sectional view of the carrier assembly of FIG. 4A with multiple magnetic fields induced.

FIG. 4B is a side schematic cross-sectional view of the carrier assembly 630 of FIG. 4A with multiple magnetic fields induced in the fluid 110. In the illustrated embodiment, the magnetic field source 100 includes a first magnetic member 106, a second magnetic member 108, and a third magnetic member 109 inducing magnetic fields in the chamber 114. The magnetic field induced by the first magnetic member 106 attracts magnetic elements 112 to a first section $A_1$ of the chamber 114. Similarly, the magnetic fields induced by the second and third magnetic members 108 and 109 attract magnetic elements 112 to second and third sections $A_2$ and $A_3$ of the chamber 114, respectively. Accordingly, the magnetic elements 112 drawn to the first section $A_1$ of the chamber 114 exert a downward force $F_1$ on the nonmagnetic float 180 as described above. The nonmagnetic float 180, in turn, exerts the downward force $F_1$ on the flexible plate 140, the flexible member 150, and the workpiece 12. Similarly, the magnetic elements 112 drawn to the second and third sections $A_2$ and $A_3$ of the chamber 114 exert downward forces $F_2$ and $F_3$ on the workpiece 12, respectively. After the magnetic fields are eliminated, the biasing members 190 return the nonmetallic float 180 to the previous equilibrium position, eliminating the forces $F_1$, $F_2$ and $F_3$ applied to workpiece 12. In other embodiments, at least a substantial portion of the magnetic field source 100 can induce a magnetic field so that a force is applied across the entire nonmagnetic float 180.

One advantage of the illustrated embodiments is the ability to apply highly localized forces to the workpiece. This highly localized force control enables the CMP process to consistently and accurately produce a uniformly planar surface on the workpiece. Moreover, the localized forces can be changed in-situ during a CMP cycle. For example, a planarizing machine having one of the illustrated carrier assemblies can monitor the planarizing rates and/or the surface of the workpiece, and accordingly, adjust the magnitude and position of the forces applied to the workpiece to produce a planar surface. Another advantage of the illustrated carrier assemblies is that they are simpler than existing systems, and consequently, reduce downtime for maintenance and/or repair and create greater throughput.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A carrier assembly for carrying a micro-device workpiece during mechanical or chemical-mechanical polishing, the carrier assembly comprising:

a head having a chamber;

a magnetic field source carried by the head, the magnetic field source including a plurality of elements positioned in a pattern for independently inducing magnetic fields in corresponding sections of the chamber;

a flexible member positioned to be proximate to the micro-device workpiece; and a magnetic fluid including magnetic elements in the chamber, wherein the magnetic fluid and/or the magnetic elements move within the chamber under the influence of the magnetic field source to exert a force against one or more selected portions of the micro-device workpiece.

2. The carrier assembly of claim 1 wherein the elements of the magnetic field source comprise a plurality of magnets.

3. The carrier assembly of claim 1 wherein the elements of the magnetic field source are arranged concentrically.

4. The carrier assembly of claim 1 wherein the elements of the magnetic field source are arranged in a grid.

5. The carrier assembly of claim 1 wherein the flexible member defines a polishing zone, and wherein the magnetic fluid and/or the magnetic elements move generally laterally relative to the polishing zone when under the influence of the magnetic field source.

6. The carrier assembly of claim 1, further comprising a nonmagnetic float positioned in the chamber, wherein the nonmagnetic float moves away from the magnetic field source and exerts pressure against at least a portion of the micro-device workpiece when one or more magnetic fields are induced.

7. The carrier assembly of claim 1, further comprising a nonmagnetic float positioned in the chamber and coupled to the magnetic field source with a biasing member, wherein the nonmagnetic float moves away from the magnetic field source and exerts pressure against at least a portion of the micro-device workpiece when one or more magnetic fields are induced.

8. The carrier assembly of claim 1 wherein the flexible member at least partially defines an enclosed cavity, and wherein the individual magnetic fields move the magnetic fluid and/or the magnetic elements such that a corresponding section of the cavity expands and exerts pressure against a portion of the micro-device workpiece.

9. A carrier assembly for holding a micro-device workpiece during mechanical or chemical-mechanical polishing, the carrier assembly comprising:

a head having a chamber;

a magnetic field source carried by the head, the magnetic field source including a plurality of elements for inducing magnetic fields in the chamber;

a flexible member in the chamber at least partially defining an enclosed cavity; and a fluid with magnetic elements in the cavity, wherein the individual magnetic fields move the fluid and/or the magnetic elements such that a corresponding section of the cavity expands and exerts pressure against a portion of the micro-device workpiece.

10. The carrier assembly of claim 9 wherein the elements of the magnetic field source are independently operable to induce corresponding magnetic fields.

11. The carrier assembly of claim 9 wherein the elements of the magnetic field source comprise a plurality of magnets.

12. The carrier assembly of claim 9 wherein the elements of the magnetic field source are arranged concentrically.

13. The carrier assembly of claim 9 wherein the flexible member defines a polishing zone, and wherein the magnetic fluid and/or the magnetic elements move generally laterally relative to the polishing zone when under the influence of the magnetic field source.

14. The carrier assembly of claim 9, further comprising a nonmagnetic float positioned within the cavity, wherein the nonmagnetic float moves away from the magnetic field source and exerts pressure against at least a portion of the micro-device workpiece when one or more magnetic fields are induced.

15. A carrier assembly for retaining a micro-device workpiece during mechanical or chemical-mechanical polishing, the carrier assembly comprising:

a head having a chamber;

a plurality of magnets for inducing magnetic fields in the chamber;

a nonmagnetic float within the chamber; and a magnetic fluid including magnetic elements within the chamber, wherein the individual magnetic fields cause the magnetic fluid and/or the magnetic elements to move within the chamber and drive the nonmagnetic float toward the micro-device workpiece such that the float exerts a force against at least a portion of the workpiece.

16. The carrier assembly of claim 15, further comprising a flexible member positioned at the chamber and between the magnetic fluid and the workpiece.

17. The carrier assembly of claim 15, further comprising an urging member coupled to the nonmagnetic float and positioned to urge the float toward the magnets.

18. The carrier assembly of claim 15 wherein the magnets are arranged concentrically.

19. The carrier assembly of claim 15 wherein the magnets are arranged in a grid.

20. The carrier assembly of claim 15 wherein the magnets comprise a plurality of electromagnets.

* * * * *